US006132948A

United States Patent [19]

Hatakeyama

[11] Patent Number: 6,132,948

[45] Date of Patent: Oct. 17, 2000

[54] PHOTOTHERMOGRAPHIC MATERIAL

[75] Inventor: Akira Hatakeyama, Kanagawa, Japan

[73] Assignee: Fuji Photo Film Co., Ltd., Minami-ashigara, Japan

[21] Appl. No.: 08/995,006

[22] Filed: Dec. 19, 1997

[30] Foreign Application Priority Data

Dec. 25, 1996 [JP] Japan ..... 8-355976

[51] Int. Cl.[7] ..... G03C 1/498; G03C 1/76

[52] U.S. Cl. ..... 430/619; 430/523; 430/531; 430/950

[58] Field of Search ..... 430/619, 523, 430/950, 531

[56] References Cited

U.S. PATENT DOCUMENTS

| | | | |
|---|---|---|---|
| 4,105,451 | 8/1978 | Smith et al. . | |
| 4,201,582 | 5/1980 | White . | |
| 4,420,531 | 12/1983 | Tokuda | 428/329 |
| 5,677,121 | 10/1997 | Tsuzuki . | |
| 5,695,920 | 12/1997 | Anderson et al. | 430/531 |
| 5,736,305 | 4/1998 | Nomura | 430/403 |

FOREIGN PATENT DOCUMENTS

| | | |
|---|---|---|
| 50-151138 | 12/1975 | Japan . |
| 53-116114 | 10/1978 | Japan . |
| 58-28737A | 2/1983 | Japan . |

*Primary Examiner*—Thorl Chea
*Attorney, Agent, or Firm*—Birch, Stewart, Kolasch & Birch, LLP

[57] ABSTRACT

A photothermographic material has a photosensitive layer containing a photosensitive silver halide, a binder, an organic silver salt and a reducing agent therefor on one surface of a support. An undercoat layer containing a styrene-butadiene copolymer is interleaved between the support and the photosensitive layer for improving the adhesion therebetween. The photosensitive layer is formed by applying an aqueous coating solution of the binder mainly composed of a polymer having an equilibrium moisture content of up to 2% by weight at 25° C. and RH 60% and drying the coating.

10 Claims, No Drawings

PHOTOTHERMOGRAPHIC MATERIAL

BACKGROUND OF THE INVENTION

This invention relates to a photothermographic material capable of forming an image through heat development and more particularly, to a photothermographic material having a photosensitive layer firmly adhered to a support.

There are known many photosensitive materials comprising a photosensitive layer on a support which are exposed imagewise to form images. Among them, a process of forming an image through heat development is known as an environmentally friendly system capable of simplifying image forming means.

The process of forming an image through heat development is disclosed, for example, in U.S. Pat. Nos. 3,152,904 and 3,457,075, and D. Morgan and B. Shely, "Thermally Processed Silver Systems" in "Imaging Processes and Materials," Neblette, 8th Ed., Sturge, V. Walworth and A. Shepp Ed., page 2, 1969. These photosensitive materials generally contain a reducible non-photosensitive silver source (e.g., organic silver salt), a catalytic amount of a photocatalyst (e.g., silver halide), and a reducing agent for silver, typically dispersed in an (organic) binder matrix. Photosensitive materials are stable at room temperature. When they are heated at an elevated temperature (e.g., 80° C. or higher) after exposure, a redox reaction takes place between the reducible silver source (functioning as an oxidizing agent) and the reducing agent to form silver. This redox reaction is promoted by the catalysis of a latent image produced by exposure. Silver formed by reaction of the organic silver salt in exposed regions provides black images in contrast to unexposed regions, forming an image.

Such photosensitive material capable of forming an image through heat development, generally referred to as photothermographic material, can satisfy the recently increasing demand for simpler processing and environmental protection.

In the prior art manufacture of photothermographic material, photosensitive layers were formed by applying a coating solution of effective components and a binder in an organic solvent and drying the coating. For example, U.S. Pat. No. 5,415,993 discloses a solution of polyvinyl butyral binder in a solvent mixture of toluene and methyl ethyl ketone. The use of organic solvents, however, is undesirable from the environmental protection and safety standpoints. Then techniques of forming photosensitive layers using aqueous solvents were devised. Such techniques of forming photosensitive layers using aqueous solvents are disclosed in, for example, JP-A 116114/1978, 151138/1975, and 28737/1983 which use gelatin, polyvinyl alcohol and polyvinyl acetal as the binder, respectively. These systems, however, have the drawback that the photosensitive layer forms an insufficient bond to the support. There is a desire to have a technique of manufacturing a photothermographic material devoid of such drawbacks using a coating solution of an aqueous solvent.

SUMMARY OF THE INVENTION

An object of the present invention is to provide a novel and improved photothermographic material having improved adhesion between a photosensitive layer and a support.

Another object of the present invention is to provide a novel and improved photothermographic material which can be prepared using an aqueous solvent that is desirable from the environmental protection and safety standpoints.

According to the invention, there is provided a photothermographic material comprising at least one photosensitive layer on at least one surface of a support and at least one undercoat layer between the support and the photosensitive layer. The undercoat layer contains a styrene-butadiene copolymer. The photosensitive layer contains a photosensitive silver halide and a binder. The photothermographic material contains an organic silver salt and a reducing agent therefor.

Preferably, the photosensitive layer has been formed by applying a coating solution of the binder dispersed in a solvent containing at least 30% by weight of water and drying the coating. The binder is preferably composed of at least 50% by weight of a polymer having an equilibrium moisture content of up to 2% by weight at 25° C. and RH 60%. Preferably, the photosensitive layer contains a styrene-butadiene copolymer as the binder.

DESCRIPTION OF THE PREFERRED EMBODIMENTS

The photothermographic material of the invention has at least one photosensitive layer containing a photosensitive silver halide and a binder on at least one surface of a support and contains an organic silver salt and a reducing agent therefor. The material further includes at least one undercoat layer containing a styrene-butadiene copolymer between the photosensitive layer and the support. With this construction, the adhesion between the photosensitive layer and the support is improved.

Photosensitive layer

There may be included one or more photosensitive layers. At least one photosensitive layer contains a binder which is preferably composed of at least 50% by weight of a polymer as defined below. Included in the polymers are acrylic resins, polyester resins, rubbery resins (e.g., SBR resin), polyurethane resins, vinyl chloride resins, vinyl acetate resins, vinylidene chloride resins, and polyolefin resins. The polymer should preferably have an equilibrium moisture content of up to 2% by weight. The lower limit of equilibrium moisture content is not critical although it is preferably 0.01% by weight, more preferably 0.03% by weight. Most preferred among these polymers is a styrene-butadiene copolymer.

The equilibrium moisture content of a polymer which is used as the binder is the moisture content (% by weight) that the polymer possesses when equilibrium is reached while the polymer is kept at a temperature of 25° C. and a relative humidity of 60%. More specifically, the equilibrium moisture content of a polymer is determined as follows. A polymer film is conditioned in an atmosphere of 25° C. and RH 60% whereupon the weight (W1 grams) of the moist film is measured. The moist film is then conditioned in an absolute dry condition at 25° C. whereupon the weight (W0 grams) of the dry film is measured again. The equilibrium moisture content (Weq) is calculated according to the following expression.

$$Weq=(W1-W0)/W0\times 100\%$$

With respect to the definition and measurement of the equilibrium moisture content, reference should be made to Japanese Polymer Society Ed., "Polymer Engineering Lecture No. 14—Polymeric Material Test Methods," Chijin Shokan, for example. An actual measurement process will be later described in Example.

The polymer may be linear, branched or crosslinked. The polymer may be either a homopolymer having a single monomer polymerized or a copolymer having two or more monomers polymerized together. Copolymers may be either random or block copolymers. The polymer preferably has a number average molecule weight Mn of about 5,000 to about 1,000,000, more preferably about 10,000 to about 1,000,000. Polymers with a too low molecular weight have insufficient dynamic strength whereas polymers with a too high molecular weight are unsuitable for film formation.

The polymer contained in the photosensitive layer according to the invention is preferably used in the form of dispersion of the polymer in an aqueous solvent. The "aqueous" solvent means that water accounts for more than 30% by weight, preferably more than 50% by weight, especially more than 80% by weight of the solvent or dispersing medium. The dispersion may be either emulsion dispersion or micelle dispersion while a polymer having hydrophilic sites in a molecule dispersed in a molecular state is also acceptable. An emulsion dispersed polymer, that is, polymer latex is especially preferred. The latex preferably has a particle size of about 10 to 500 nm.

Preferred illustrative examples of the polymer are shown below as P-1 to P-7.

| Designation | Units | Mn |
|---|---|---|
| P-1 | $-(MMA)_{55}-(EA)_{40}-(MAA)_5-$ latex | 58,000 |
| P-2 | $-(MMA)_{60}-(2EHA)_{25}-(St)_{12}-(AA)_3-$ latex | 79,000 |
| P-3 | $-(St)_{55}-(Bu)_{40}-(MAA)_5-$ latex | 99,000 |
| P-4 | $-(St)_{70}-(Bu)_{20}-(AN)_8-(AA)_2-$ latex | 67,000 |
| P-5 | $-(St)_{75}-(Bu)_{20}-(DVB)_3-(MAA)_2-$ latex | 173,000 |
| P-6 | $-(VC)_{60}-(MMA)_{35}-(MAA)_5-$ latex | 42,000 |
| P-7 | $-(VDC)_{80}-(MMA)_5-(EA)_5-(AN)_7-(MAA)_3-$ latex | 65,000 |

MMA: methyl methacrylate
EA: ethyl acrylate
MAA: methacrylic acid
2EHA: 2-ethylhexyl acrylate
St: styrene
DVB: divinyl benzene
AA: acrylic acid
VC: vinyl chloride
VDC: vinylidene chloride
AN: acrylonitrile
Mn: number average molecular weight Numerical values are % by weight.

These polymers are commercially available. Useful commercial examples of the polymer latex include acrylic resin latices such as Sebian A-4635, 46583, and 4601 (Daicell Chemical K.K.) and Nipol Lx811, 814, 821, 820 and 857 (Nippon Zeon K.K.); polyester resin latices such as FINETEX ES650, 611, 675 and 850 (Dai-Nihon Ink Chemical K.K.) and WD-size and WMS (Eastman Chemical Products, Inc.); polyurethane resin latices such as HYDRAN AP10, 20, 30, and 40 (Dai-Nihon Ink Chemical K.K.); vinyl chloride resin latices such as G351 and G576 (Nippon Zeon K.K.); vinylidene chloride resin latices such as L502 and L513 (Asahi Chemicals K.K.); and olefin resin latices such as Chemipearl S120 and SA100 (Mitsui Petro-Chemical K.K.). These polymers may be used alone or in admixture of two or more.

Undercoat layer

According to the invention, the undercoat layer contains a styrene-butadiene copolymer as a binder. The "styrene-butadiene copolymer" encompasses polymers containing styrene and butadiene in their molecular chain. The contents of styrene and butadiene in polymers are not critical although the preferred polymers contain about 20 to 70% by weight of styrene and about 20 to 75% by weight of butadiene. The ratio of styrene to butadiene preferably ranges from 99/1 to 40/60 when expressed in molar ratio.

In addition to styrene and butadiene, the styrene-butadiene copolymer may have another component copolymerized therein, for example, acid components such as acrylic acid, methacrylic acid, and itaconic acid, components capable of three-dimensional crosslinking such as divinyl benzene, and acrylonitrile, methyl methacrylate, and ethyl acrylate. The copolymer should preferably contain more than 50% by weight of styrene and butadiene combined.

Preferably the styrene-butadiene copolymer has a number average molecular weight of about 2,000 to 1,000,000, more preferably about 5,000 to 500,000.

In the practice of the invention, the styrene-butadiene copolymer is usually a random copolymer although a block copolymer is acceptable. The styrene-butadiene copolymer may be a linear, branched or crosslinked one. It is often used in the form of particles having a mean particle size of about 0.05 to 0.5 $\mu$m.

Preferred illustrative examples of the styrene-butadiene copolymer are given below as P-101 to P-106 wherein abbreviations are as defined above.

| Designation | Units | Mn |
|---|---|---|
| P-101 | $-(St)_{50}-(Bu)_{42}-(AA)_8-$ latex | 36,000 |
| P-102 | $-(St)_{40}-(Bu)_{50}-(AN)_5-(MMA)_5-$ latex | 92,000 |
| P-103 | $-(St)_{40}-(Bu)_{45}-(AN)_5-(DVB)_5-(AA)_5-$ latex | 122,000 |
| P-104 | $-(St)_{55}-(Bu)_{40}-(MAA)_5-$ latex | 80,000 |
| P-105 | $-(St)_{30}-(Bu)_{40}-(MMA)_{10}-(AN)_5-(DVB)_5-(AA)_{10}-$ latex | 142,000 |
| P-106 | $-(St)_{40}-(Bu)_{35}-(EA)_{10}-(AN)_5-(DVB)_5-(AA)_5-$ latex | 163,000 |

These styrene-butadiene copolymers are commercially available. Useful commercial examples of the styrene-butadiene copolymer include LACSTAR 5215A and DS-6137310KDN-703 (Dai-Nihon Ink Chemical K.K.), Nipol Lx426, 432A and 435 (Nippon Zeon K.K.), and L1151, 1260 and 1876 (Asahi Chemicals K.K.). These styrene-butadiene copolymers may be used alone or in admixture of two or more.

Preferably the undercoat layer contains the styrene-butadiene copolymer in an amount of at least 50%, more preferably at least 70% by weight of the entire binder.

If desired, the undercoat layer contains a polymer other than the styrene-butadiene copolymer. Such additional polymers include water-soluble polymers such as gelatin and polyvinyl alcohol and hydrophobic polymers such as polyesters and polyacrylate.

In addition to the binder, the undercoat layer contains a crosslinking agent, matte agent, dye, filler, surfactant and other additives if desired. Exemplary crosslinking agents are well-known compounds such as epoxy, isocyanate and melamine compounds. Active halogen crosslinking agents as described in JP-A 114120/1976 are especially useful.

Useful matte agents are fine particles of styrene, polymethyl methacrylate and silica having a mean particle size of about 0.2 to 5 $\mu$m. Colloidal silica is a typical filler. Exemplary surfactants include anionic, nonionic and cationic surfactants. Dyes include antihalation dyes and toner dyes.

The undercoat layer may be formed by applying a coating solution of either an aqueous or organic solvent system, followed by drying. Aqueous coating solutions are preferred from the standpoints of cost and environment. The coating solution for the undercoat layer should preferably contain 1 to 40%, more preferably 10 to 25% by weight of the styrene-butadiene copolymer. The techniques of applying and drying the undercoat layer are not critical. The applying technique may be any of well-known techniques including bar coater, dip coater, curtain coater, immersion, air knife, and hopper coating techniques. Drying may be carried out at a temperature of about 25 to 200° C. for about ½ to 20 minutes. The undercoat layer preferably has a thickness of about 0.1 to 10 μm, more preferably about 0.2 to 2 μm. When plural undercoat layers are formed, each layer has such a preferred thickness.

In addition to the above-mentioned undercoat layer containing the styrene-butadiene copolymer, the photothermographic material may have another undercoat layer which does not contain the styrene-butadiene copolymer. The binder in the other undercoat layer may be gelatin or the like. The other undercoat layer preferably has a thickness of about 0.1 to 2 μm. The total thickness of undercoat layers is preferably about 0.1 to 15 μm, more preferably about 0.2 to 5 μm.

Various supports may be used in the photothermographic material of the invention. They are of well-known materials such as paper, polyester, polystyrene, and polycarbonate. The supports are usually about 30 to 1,000 μm thick. Among others, biaxially oriented polyethylene terephthalate (PET) film of about 50 to 300 μm thick is preferred as the support from the standpoints of strength and chemical resistance. If desired, the support is dyed, surface treated by corona discharge, glow discharge or flame treatment, or subbed.

Silver halide

A method for forming a photosensitive silver halide is well known in the art. Any of the methods disclosed in Research Disclosure No. 17029 (June 1978) and U.S. Pat. No. 3,700,458, for example, may be used. Illustrative methods which can be used herein are a method of adding a halogen-containing compound to a pre-formed organic silver salt to convert a part of silver of the organic silver salt into photosensitive silver halide and a method of adding a silver-providing compound and a halogen-providing compound to a solution of gelatin or another polymer to form photo-sensitive silver halide grains and mixing the grains with an organic silver salt. The latter method is preferred in the practice of the invention. The photosensitive silver halide should preferably have a smaller grain size for the purpose of minimizing white turbidity after image formation. Specifically, the grain size is less than 0.20 μm, preferably 0.01 μm to 0.15 μm, most preferably 0.02 μm to 0.12 μm. The term grain size designates the length of an edge of a silver halide grain where silver halide grains are regular grains of cubic or octahedral shape. Where silver halide grains are tabular, the grain size is the diameter of an equivalent circle having the same area as the projected area of a major surface of a tabular grain. Where silver halide grains are not regular, for example, in the case of spherical or rod-shaped grains, the grain size is the diameter of an equivalent sphere having the same volume as a grain.

The shape of silver halide grains may be cubic, octahedral, tabular, spherical, rod-like and potato-like, with cubic and tabular grains being preferred in the practice of the invention. Where tabular silver halide grains are used, they should preferably have an average aspect ratio of from 100:1 to 2:1, more preferably from 50:1 to 3:1. Silver halide grains having rounded corners are also preferably used. No particular limit is imposed on the face indices (Miller indices) of an outer surface of silver halide grains. Preferably silver halide grains have a high proportion of {100} face featuring high spectral sensitization efficiency upon adsorption of a spectral sensitizing dye. The proportion of {100} face is preferably at least 50%, more preferably at least 65%, most preferably at least 80%. Note that the proportion of Miller index {100} face can be determined by the method described in T. Tani, J. Imaging Sci., 29, 165 (1985), utilizing the adsorption dependency of {111} face and {100} face upon adsorption of a sensitizing dye.

The halogen composition of photosensitive silver halide is not critical and may be any of silver chloride, silver chlorobromide, silver bromide, silver iodobromide, silver iodochlorobromide, and silver iodide. Silver bromide or silver iodobromide is preferred in the practice of the invention. Most preferred is silver iodobromide preferably having a silver iodide content of 0.1 to 40 mol %, especially 0.1 to 20 mol %. The halogen composition in grains may have a uniform distribution or a non-uniform distribution wherein the halogen concentration changes in a stepped or continuous manner. Preferred are silver iodobromide grains having a higher silver iodide content in the interior. Silver halide grains of the core/shell structure are also useful. Such core/shell grains preferably have a multilayer structure of 2 to 5 layers, more preferably 2 to 4 layers.

Preferably the photosensitive silver halide grains used herein contain at least one complex of a metal selected from the group consisting of rhodium, rhenium, ruthenium, osmium, iridium, cobalt, mercury, and iron. The metal complexes may be used alone or in admixture of two or more complexes of a common metal or different metals. An appropriate content of the metal complex is $1\times10^{-9}$ to $1\times10^{-2}$ mol, more preferably $1\times10^{-8}$ to $1\times10^{-4}$ mol per mol of silver. Illustrative metal complex structures are those described in JP-A 225449/1995. Preferred among cobalt and iron complexes are hexacyano metal complexes. Illustrative, non-limiting examples of cobalt and iron complexes include hexacyano metal complexes such as ferricyanate, ferrocyanate, and hexacyanocobaltate. The distribution of the metal complex in silver halide grains is not critical. That is, the metal complex may be contained in silver halide grains uniformly or at a high concentration in either the core or the shell.

Photosensitive silver halide grains may be desalted by any of well-known water washing methods such as noodle and flocculation methods although silver halide grains may be either desalted or not according to the invention.

The photosensitive silver halide grains used herein should preferably be chemically sensitized. Preferred chemical sensitization methods are sulfur, selenium, and tellurium sensitization methods which are well known in the art. Also useful are a noble metal sensitization method using compounds of gold, platinum, palladium, and iridium and a reduction sensitization method. In the sulfur, selenium, and tellurium sensitization methods, any of compounds well known for the purpose may be used. For example, the compounds described in JP-A 128768/1995 are useful. Exemplary tellurium sensitizing agents include diacyltellurides, bis(oxycarbonyl)tellurides, bis(carbamoyl) tellurides, bis(oxycarbonyl)ditellurides, bis(carbamoyl) ditellurides, compounds having a P=Te bond, tellurocarboxylic salts, Te-organyltellurocarboxylic esters, di(poly) tellurides, tellurides, telluroles, telluroacetals, tellurosulfonates, compounds having a P-Te bond, Te-containing heterocyclics, tellurocarbonyl compounds, inorganic tellurium compounds, and colloidal tellurium. The preferred compounds used in the noble metal sensitization method include chloroauric acid, potassium chloroaurate, potassium aurithiocyanate, gold sulfide, and gold selenide as well as the compounds described in U.S. Pat. No. 2,448,060 and UKP 618,061. Illustrative examples of the compound used in the reduction sensitization method include ascorbic acid, thiourea dioxide, stannous chloride, aminoiminomethane-sulfinic acid, hydrazine derivatives, boran compounds, silane compounds, and polyamine compounds. Reduction sensitization may also be accomplished by ripening the emulsion while maintaining it at pH 7 or higher or at pAg 8.3 or lower. Reduction sensitization may also be accomplished by introducing a single addition portion of silver ion during grain formation.

According to the invention, the photosensitive silver halide is preferably used in an amount of 0.01 to 0.5 mol, more preferably 0.02 to 0.3 mol, most preferably 0.03 to 0.25 mol per mol of the organic silver salt. With respect to a method and conditions of admixing the separately prepared photosensitive silver halide and organic silver salt, there may be used a method of admixing the separately prepared photosensitive silver halide and organic silver salt in a high speed agitator, ball mill, sand mill, colloidal mill, vibratory mill or homogenizer or a method of preparing an organic silver salt by adding a preformed photosensitive silver halide at any timing during preparation of an organic silver salt. Any desired mixing method may be used insofar as the benefits of the invention are fully achievable.

One of the preferred methods for preparing the silver halide according to the invention is a so-called halidation method of partially halogenating the silver of an organic silver salt with an organic or inorganic halide. Any of organic halides which can react with organic silver salts to form a silver halide may be used. Exemplary organic halides are N-halogenoimides (e.g., N-bromosuccinimide), halogenated quaternary nitrogen compounds (e.g., tetrabutylammonium bromide), and aggregates of a halogenated quaternary nitrogen salt and a molecular halogen (e.g., pyridinium bromide perbromide). Any of inorganic halides which can react with organic silver salts to form a silver halide may be used. Exemplary inorganic halides are alkali metal and ammonium halides (e.g., sodium chloride, lithium bromide, potassium iodide, and ammonium bromide), alkaline earth metal halides (e.g., calcium bromide and magnesium chloride), transition metal halides (e.g., ferric chloride and cupric bromide), metal complexes having a halogen ligand (e.g., sodium iridate bromide and ammonium rhodate chloride), and molecular halogens (e.g., bromine, chlorine and iodine). A mixture of organic and inorganic halides may also be used.

The amount of the halide added for the halidation purpose is preferably 1 mmol to 500 mmol, especially 10 mmol to 250 mmol of halogen atom per mol of the organic silver salt.

Organic Silver salt

The organic silver salt used herein is a silver salt which is relatively stable to light, but forms a silver image when heated at 80° C. or higher in the presence of an exposed photocatalyst (as typified by a latent image of photosensitive silver halide) and a reducing agent. The organic silver salt may be of any desired organic compound containing a source capable of reducing silver ion. Preferred are silver salts of organic acids, typically long chain aliphatic carboxylic acids having 10 to 30 carbon atoms, especially 15 to 28 carbon atoms. Also preferred are complexes of organic or inorganic silver salts with ligands having a stability constant in the range of 4.0 to 10.0. A silver-providing substance is preferably used in an amount of about 5 to 70% by weight of an image forming layer. Preferred organic silver salts include silver salts of organic compounds having a carboxyl group. Examples include silver salts of aliphatic carboxylic acids and silver salts of aromatic carboxylic acids though not limited thereto. Preferred examples of the silver salt of aliphatic carboxylic acid include silver behenate, silver arachidate, silver stearate, silver oleate, silver laurate, silver caproate, silver myristate, silver palmitate, silver maleate, silver fumarate, silver tartrate, silver linolate, silver butyrate, silver camphorate and mixtures thereof.

In the practice of the invention, silver salts of compounds having a mercapto or thion group and derivatives thereof may also be used. Preferred examples of these compounds include a silver salt of 3-mercapto-4-phenyl- 1,2,4-triazole, a silver salt of 2-mercaptobenzimidazole, a silver salt of 2-mercapto-5-aminothiadiazole, a silver salt of 2-(ethylglycolamido)benzothiazole, silver salts of thioglycolic acids such as silver salts of S-alkylthio-glycolic acids wherein the alkyl group has 12 to 22 carbon atoms, silver salts of dithiocarboxylic acids such as a silver salt of dithioacetic acid, silver salts of thioamides, a silver salt of 5-carboxyl-1-methyl-2-phenyl-4-thiopyridine, silver salts of mercaptotriazines, a silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274 and silver salts of thion compounds such as a silver salt of 3-(3-carboxyethyl)-4-methyl-4-thiazoline-2-thion as described in U.S. Pat. No. 3,301,678. Compounds containing an imino group may also be used. Preferred examples of these compounds include silver salts of benzotriazole and derivatives thereof, for example, silver salts of benzotriazoles such as silver methylbenzotriazole, silver salts of halogenated benzotriazoles such as silver 5-chlorobenzotriazole as well as silver salts of 1,2,4-triazole and 1-H-tetrazole and silver salts of imidazole and imidazole derivatives as described in U.S. Pat. No. 4,220,709. Also useful are various silver acetylide compounds as described, for example, in U.S. Pat. Nos. 4,761,361 and 4,775,613.

The organic silver salt which can be used herein may take any desired shape although needle crystals having a minor axis and a major axis are preferred. In the practice of the invention, grains should preferably have a minor axis of 0.01 μm to 0.20 μm, more preferably 0.01 μm to 0.15 μm and a major axis of 0.10 μm to 5.0 μm, more preferably 0.10 μm to 4.0 μm. The grain size distribution is desirably monodisperse. The monodisperse distribution means that a standard deviation of the length of minor and major axes divided by the length, respectively, expressed in percent, is preferably up to 100%, more preferably up to 80%, most preferably up to 50%. It can be determined from the measurement of the shape of organic silver salt grains using an image obtained through a transmission electron microscope. Another method for determining a monodisperse distribution is to determine a standard deviation of a volume weighed mean diameter. The standard deviation divided by the volume weighed mean diameter, expressed in percent, which is a coefficient of variation, is preferably up to 100%, more preferably up to 80%, most preferably up to 50%. It may be determined by irradiating laser light, for example, to organic silver salt grains dispersed in liquid and determining the autocorrelation function of the fluctuation of scattering light relative to a time change, and obtaining the grain size (volume weighed mean diameter) therefrom.

The organic silver salt used herein is preferably desalted. The desalting method is not critical. Any well-known method may be used although well-known filtration methods such as centrifugation, suction filtration, ultrafiltration, and flocculation/water washing are preferred.

In the practice of the invention, the organic silver salt is prepared into a solid microparticulate dispersion using a dispersant in order to provide fine particles of small size and free of flocculation. A solid micro-particulate dispersion of the organic silver salt may be prepared by mechanically dispersing the salt in the presence of dispersing aids by well-known comminuting means such as ball mills, vibrating ball mills, planetary ball mills, sand mills, colloidal mills, jet mills, and roller mills.

The dispersant used in the preparation of a solid micro-particulate dispersion of the organic silver salt may be selected from synthetic anionic polymers such as polyacrylic acid, copolymers of acrylic acid, copolymers of maleic acid, copolymers of maleic acid monoester, and copolymers of acryloylmethylpropanesulfonic acid; semi-synthetic anionic polymers such as carboxymethyl starch and carboxymethyl cellulose; anionic polymers such as alginic acid and pectic acid; anionic surfactants as described in JP-A 92716/1977 and WO 88/04794; the compounds described in Japanese Patent Application No. 350753/1995; well-known anionic, nonionic and cationic surfactants; and well-known polymers such as polyvinyl alcohol, polyvinyl pyrrolidone, carboxymethyl cellulose, hydroxypropyl cellulose, and hydroxypropylmethyl cellulose, as well as naturally occurring high molecular weight compounds such as gelatin.

In general, the dispersant is mixed with the organic silver salt in powder or wet cake form prior to dispersion. The resulting slurry is fed into a dispersing machine. Alternatively, a mixture of the dispersant with the organic silver salt is subject to heat treatment or solvent treatment to form a dispersant-bearing powder or wet cake of the organic silver salt. It is acceptable to effect pH control with a suitable pH adjusting agent before, during or after dispersion.

Rather than mechanical dispersion, fine particles can be formed by roughly dispersing the organic silver salt in a solvent through pH control and thereafter, changing the pH in the presence of dispersing aids. An organic solvent can be used as the solvent for rough dispersion although the organic solvent is usually removed at the end of formation of fine particles.

The thus prepared dispersion may be stored while continuously stirring for the purpose of preventing fine particles from settling during storage. Alternatively, the dispersion is stored after adding hydrophilic colloid to establish a highly viscous state (for example, in a jelly-like state using gelatin). An antiseptic agent may be added to the dispersion in order to prevent the growth of bacteria during storage.

The organic silver salt is used in any desired amount, preferably about 0.1 to 5 g per square meter of photosensitive material, more preferably about 1 to 3 g/m$^2$.

Reducing agent

The reducing agent for the organic silver salt may be any of substances, preferably organic substances, that reduce silver ion into metallic silver. Conventional photographic developing agents such as Phenidone®, hydroquinone and catechol are useful although hindered phenols are preferred reducing agents. The reducing agent should preferably be contained in an amount of 0.05 to 0.5 mol, especially 0.1 to 0.4 mol per mol of silver on the image forming layer-bearing side. The reducing agent may be added to any layer on the image forming layer-bearing side. In a multilayer embodiment wherein the reducing agent is added to a layer other than the image forming layer, the reducing agent should preferably be contained in a slightly larger amount of about 0.1 to 0.5 mol per mol of silver. The reducing agent may take the form of a precursor which is modified so as to exert its effective function only at the time of development.

For photothermographic materials using organic silver salts, a wide range of reducing agents are disclosed, for example, in JP-A 6074/1971, 1238/1972, 33621/1972, 46427/1974, 115540/1974, 14334/1975, 36110/1975, 147711/1975, 32632/1976, 1023721/1976, 32324/1976, 51933/1976, 84727/1977, 108654/1980, 146133/1981, 82828/1982, 82829/1982, 3793/1994, U.S. Pat. Nos. 3,667,958, 3,679,426, 3,751,252, 3,751,255, 3,761,270, 3,782,949, 3,839,048, 3,928,686, 5,464,738, German Patent No. 2321328, and EP 692732. Exemplary reducing agents include amidoximes such as phenylamidoxime, 2-thienylamidoxime, and p-phenoxyphenyl-amidoxime; azines such as 4-hydroxy-3,5-dimethoxybenzaldehydeazine; combinations of aliphatic carboxylic acid arylhydrazides with ascorbic acid such as a combination of 2,2-bis(hydroxymethyl)propionyl-β-phenylhydrazine with ascorbic acid; combinations of polyhydroxybenzenes with hydroxylamine, reductone and/or hydrazine, such as combinations of hydroquinone with bis(ethoxyethyl)hydroxyl-amine, piperidinohexosereductone or formyl-4-methylphenyl-hydrazine; hydroxamic acids such as phenylhydroxamic acid, p-hydroxyphenylhydroxamic acid, and β-anilinehydroxamic acid; combinations of azines with sulfonamidophenols such as a combination of phenothiazine with 2,6-dichloro-4-benzene-sulfonamidephenol; α-cyanophenyl acetic acid derivatives such as ethyl-α-cyano-2-methylphenyl acetate and ethyl-α-cyanophenyl acetate; bis-β-naphthols such as 2,2-dihydroxy-1,1-binaphthyl, 6,6-dibromo-2,2-dihydroxy-1,1-binaphthyl, and bis(2-hydroxy-1-naphthyl)methane; combinations of bis-β-naphthols with 1,3-dihydroxybenzene derivatives such as 2,4-dihydroxybenzophenone and 2,4-dihydroxyacetophenone; 5-pyrazolones such as 3-methyl-1-phenyl-5-pyrazolone; reductones such as dimethylaminohexosereductone, anhydro-dihydroaminohexosereductone and anhydrodihydropiperidone-hexosereductone; sulfonamidephenol reducing agents such as 2,6-dichloro-4-benzenesulfonamidephenol and p-benzenesulfonamidephenol; 2-phenylindane-1,3-dione, etc.; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methyl-phenyl)propane, 4,4-ethylidene-bis(2-t-butyl-6-methyl-phenol), 1,1-bis(2-hydroxy-3,5-dimethylphenyl)-3,5,5-trimethylhexane, and 2,2-bis(3,5-dimethyl-4-hydroxyphenyl)-propane; ascorbic acid derivatives such as 1-ascorbyl palmitate and ascorbyl stearate; aldehydes and ketones such as benzil and diacetyl; 3-pyrazolidones and certain indane-1,3-diones; and chromanols (tocopherols). Preferred reducing agents are bisphenols and chromanols.

In the practice of the invention, the reducing agent may be added in any desired form, for example, as a solution, powder and solid particle dispersion. The solid particle dispersion of the reducing agent is prepared by well-known finely dividing means such as ball mills, vibratory ball mills, sand mills, colloid mills, jet mills, and roller mills. Dispersing aids may be used in preparing the solid microparticulate dispersion.

Other components

A higher optical density is sometimes achieved when an additive known as a "toner" for improving images is contained. The toner is also sometimes advantageous in forming black silver images. The toner is preferably used in an amount of 0.1 to 50 mol %, especially 0.5 to 20 mol % based on the moles of silver on the image forming layer side. The toner may take the form of a precursor which is modified so as to exert its effective function only at the time of development.

For photothermographic materials using organic silver salts, a wide range of toners are disclosed, for example, in JP-A 6077/1971, 10282/1972, 5019/1974, 5020/1974, 91215/1974, 2524/1975, 32927/1975, 67132/1975, 67641/1975, 114217/1975, 3223/1976, 27923/1976, 14788/1977, 99813/1977, 1020/1978, 76020/1978, 156524/1979, 156525/1979, 183642/1986, and 56848/1992, JP-B 10727/1974 and 20333/1979, U.S. Pat. Nos. 3,080,254, 3,446,648, 3,782,941, 4,123,282, 4,510,236, UKP 1,380,795, and Belgian Patent No. 841,910. Examples of the toner include phthalimide and N-hydroxyphthalimide; cyclic imides such as succinimide, pyrazoline-5-one, quinazoline, 3-phenyl-2-pyrazolin-5-one, 1-phenylurazol, quinazoline and 2,4-thiazolizinedione; naphthalimides such as N-hydroxy-1,8-naphthalimide; cobalt complexes such as cobaltic hexamine trifluoroacetate; mercaptans as exemplified by 3-mercapto-1,2,4-triazole, 2,4-dimercapto-pyrimidine, 3-mercapto-4,5-diphenyl-1,2,4-triazole, and 2,5-dimercapto-1,3,4-thiadiazole; N-(aminomethyl)aryldicarboxy-imides such as (N,N-dimethylaminomethyl)phthalimide and N,N-(dimethylaminomethyl)-naphthalene-2,3-dicarboxyimide; blocked pyrazoles, isothiuronium derivatives and certain photo-bleach agents such as N,N'-hexamethylenebis(1-carbamoyl-3,5-dimethylpyrazole), 1,8-(3,6-diazaoctane)-bis(isothiuroniumtrifluoroacetate) and 2-tribromomethylsulfonyl-benzothiazole; 3-ethyl-5-{(3-ethyl-2-benzothiazolinylidene)-1-methylethylidene}-2-thio-2,4-oxazolidinedione; phthalazinone, phthalazinone derivatives or metal salts, or derivatives such as 4-(1-naphthyl)-phthalazinone, 6-chlorophthalazinone, 5,7-dimethoxyphthalazinone and 2,3-dihydro-1,4-phthalazinedione; combinations of phthalazinone with phthalic acid derivatives (e.g., phthalic acid, 4-methylphthalic acid, 4-nitrophthalic acid, and tetrachlorophthalic anhydride); phthalazine, phthalazine derivatives or metal salts, or derivatives such as 4-(1-naphthyl)phthlazine, 6-chlorophthalazine, 5,7-dimethoxyphthalazine and 2,3-dihydrophthlazine; combinations of phthalazine with phthalic acid derivatives (e.g., phthalic acid, 4-methylphthalic acid, 4-nitrophthalic acid, and tetrachlorophthalic anhydride); quinazolinedione, benzoxazine or naphthoxazine derivatives; rhodium complexes which function not only as a tone regulating agent, but also as a source of halide ion for generating silver halide in situ, for example, ammonium hexachlororhodinate (III), rhodium bromide, rhodium nitrate and potassium hexachlororhodinate (III); inorganic peroxides and persulfates such as ammonium peroxide disulfide and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidine and asym-triazines such as 2,4-dihydroxypyrimidine and 2-hydroxy-4-aminopyrimidine; azauracil and tetraazapentalene derivatives such as 3,6-dimercapto-1,4-diphenyl-1H,4H-2,3a,5,6a-tetraazapentalene, and 1,4-di(o-chlorophenyl)-3,6-dimercapto-1H,4H-2,3a,5,6a-tetraazapentalene.

The toner may be added in any desired form, for example, as a solution, powder and solid microparticulate dispersion. The solid microparticulate dispersion of the toner is prepared by well-known finely dividing means such as ball mills, vibratory ball mills, sand mills, colloid mills, jet mills, and roller mills. Dispersing aids may be used in preparing the solid microparticulate dispersion.

A sensitizing dye is used in the practice of the invention. There may be used any of sensitizing dyes which can spectrally sensitize silver halide grains in a desired wavelength region when adsorbed to the silver halide grains. The sensitizing dyes used herein include cyanine dyes, merocyanine dyes, complex cyanine dyes, complex merocyanine dyes, holopolar cyanine dyes, styryl dyes, hemicyanine dyes, oxonol dyes, and hemioxonol dyes. Useful sensitizing dyes which can be used herein are described in Research Disclosure, Item 17643 IV-A (December 1978, page 23), ibid., Item 1831 X (August 1979, page 437) and the references cited therein. It is advantageous to select a sensitizing dye having appropriate spectral sensitivity to the spectral properties of a particular light source of various laser imagers, scanners, image setters and printing plate-forming cameras.

Exemplary dyes for spectral sensitization to red light include compounds I-1 to I-38 described in JP-A 18726/1979, compounds I-1 to I-35 described in JP-A 75322/1994, compounds I-1 to I-34 described in JP-A 287338/1995, dyes 1 to 20 described in JP-B 39818/1980, compounds I-1 to I-37 described in JP-A 284343/1987, and compounds I-1 to I-34 described in JP-A 287338/1995 for red light sources such as He—Ne lasers, red laser diodes and LED.

For semiconductor laser light sources in the wavelength range of 750 to 1,400 nm, spectral sensitization may be advantageously done with various known dyes including cyanine, merocyanine, styryl, hemicyanine, oxonol, hemioxonol, and xanthene dyes. Useful cyanine dyes are cyanine dyes having a basic nucleus such as a thiazoline, oxazoline, pyrroline, pyridine, oxazole, thiazole, selenazole and imidazole nucleus. Preferred examples of the useful merocyanine dye contain an acidic nucleus such as a thiohydantoin, rhodanine, oxazolidinedione, thiazolinedione, barbituric acid, thiazolinone, malononitrile, and pyrazolone nucleus in addition to the above-mentioned basic nucleus. Among the above-mentioned cyanine and merocyanine dyes, those having an imino or carboxyl group are especially effective. A suitable choice may be made of well-known dyes as described, for example, in U.S. Pat. Nos. 3,761,279, 3,719,495, and 3,877,943, UKP 1,466,201, 1,469,117, and 1,422,057, JP-B 10391/1991 and 52387/1994, JP-A 341432/1993, 194781/1994, and 301141/1994.

Especially preferred dye structures are cyanine dyes having a thioether bond-containing substituent group, examples of which are the cyanine dyes described in JP-A 58239/1987, 138638/1991, 138642/1991, 255840/1992, 72659/1993, 72661/1993, 222491/1994, 230506/1990, 258757/1994, 317868/1994, and 324425/1994, Publication of International Patent Application No. 500926/1995, and U.S. Pat. No. 5,541,054; dyes having a carboxylic group, examples of which are the dyes described in JP-A 163440/1991, 301141/1994 and U.S. Pat. No. 5,441,899; and merocyanine dyes, polynuclear merocyanine dyes, and polynuclear cyanine dyes, examples of which are the dyes described in JP-A 6329/1972, 105524/1974, 127719/1976, 80829/1977, 61517/1979, 214846/1984, 6750/1985, 159841/1988, 35109/1994, 59381/1994, 146537/1995, Publication of International Patent Application No. 50111/1993, UKP 1,467,638, and U.S. Pat. No. 5,281,515.

Also useful in the practice of the invention are dyes capable of forming the J-band as disclosed in U.S. Pat. Nos. 5,510,236, 3,871,887 (Example 5), JP-A 96131/1990 and 48753/1984.

These sensitizing dyes may be used alone or in admixture of two or more. A combination of sensitizing dyes is often used for the purpose of supersensitization. In addition to the sensitizing dye, the emulsion may contain a dye which itself has no spectral sensitization function or a compound which does not substantially absorb visible light, but is capable of supersensitization. Useful sensitizing dyes, combinations of dyes showing supersensitization, and compounds showing supersensitization are described in Research Disclosure, Vol. 176, 17643 (December 1978), page 23, IV J and JP-B 25500/1974 and 4933/1968, JP-A 19032/1984 and 192242/1984.

The sensitizing dye may be added to a silver halide emulsion by directly dispersing the dye in the emulsion or by dissolving the dye in a solvent and adding the solution to the emulsion. The solvent used herein includes water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide and mixtures thereof.

Also useful are a method of dissolving a dye in a volatile organic solvent, dispersing the solution in water or hydrophilic colloid and adding the dispersion to an emulsion as disclosed in U.S. Pat. No. 3,469,987, a method of dissolving a dye in an acid and adding the solution to an emulsion or forming an aqueous solution of a dye with the aid of an acid or base and adding it to an emulsion as disclosed in JP-B 23389/1969, 27555/1969 and 22091/1982, a method of forming an aqueous solution or colloidal dispersion of a dye with the aid of a surfactant and adding it to an emulsion as disclosed in U.S. Pat. Nos. 3,822,135 and 4,006,025, a method of directly dispersing a dye in hydrophilic colloid and adding the dispersion to an emulsion as disclosed in JP-A 102733/1978 and 105141/1983, and a method of dissolving a dye using a compound capable of red shift and adding the solution to an emulsion as disclosed in JP-A 74624/1976. It is also acceptable to apply ultrasonic waves to form a solution.

The time when the sensitizing dye is added to the silver halide emulsion according to the invention is at any step of an emulsion preparing process which has been acknowledged effective. The sensitizing dye may be added to the emulsion at any stage or step before the emulsion is coated, for example, at a stage prior to the silver halide grain forming step and/or desalting step, during the desalting step and/or a stage from desalting to the start of chemical ripening as disclosed in U.S. Pat. Nos. 2,735,766, 3,628,960, 4,183,756, and 4,225,666, JP-A 184142/1983 and 196749/1985, and a stage immediately before or during chemical ripening and a stage from chemical ripening to emulsion coating as disclosed in JP-A 113920/1983. Also as disclosed in U.S. Pat. No. 4,225,666 and JP-A 7629/1983, an identical compound may be added alone or in combination with a compound of different structure in divided portions, for example, in divided portions during a grain forming step and during a chemical ripening step or after the completion of chemical ripening, or before or during chemical ripening and after the completion thereof. The type of compound or the combination of compounds to be added in divided portions may be changed.

The amount of the sensitizing dye used may be an appropriate amount complying with sensitivity and fog although the preferred amount is about $10^{-6}$ to 1 mol, more preferably $10^{-4}$ to $10^{-1}$ mol per mol of the silver halide in the photosensitive layer.

In one preferred embodiment, the photothermographic material of the invention is a one-side photosensitive material having at least one photosensitive (or emulsion) layer containing a silver halide emulsion on one surface and a backing layer on the other surface of the support.

To the one-side photosensitive material, a matte agent may be added for improving the feed thereof. The matte agents used herein are generally microparticulate water-insoluble organic or inorganic compounds. There may be used any desired one of matte agents, for example, well-known matte agents including organic matte agents as described in U.S. Pat. Nos. 1,939,213, 2,701,245, 2,322,037, 3,262,782, 3,539,344, and 3,767,448 and inorganic matte agents as described in U.S. Pat. Nos. 1,260,772, 2,192,241, 3,257,206, 3,370,951, 3,523,022, and 3,769,020. Illustrative examples of the organic compound which can be used as the matte agent are given below; exemplary water-dispersible vinyl polymers include poly-methyl acrylate, polymethyl methacrylate, polyacrylonitrile, acrylonitrile-α-methylstyrene copolymers, polystyrene, styrene-divinylbenzene copolymers, polyvinyl acetate, polyethylene carbonate, and polytetrafluoroethylene; exemplary cellulose derivatives include methyl cellulose, cellulose acetate, and cellulose acetate propionate; exemplary starch derivatives include carboxystarch, carboxynitrophenyl starch, urea-formaldehyde-starch reaction products, gelatin hardened with well-known curing agents, and hardened gelatin which has been coaceruvation hardened into microcapsulated hollow particles. Preferred examples of the inorganic compound which can be used as the matte agent include silicon dioxide, titanium dioxide, magnesium dioxide, aluminum oxide, barium sulfate, calcium carbonate, silver chloride and silver bromide desensitized by a well-known method, glass, and diatomaceous earth. The aforementioned matte agents may be used as a mixture of substances of different types if necessary.

No particular limit is imposed on the size and shape of the matte agent. The matte agent used herein may have any desired shape, for example, spherical and irregular shapes. The matte agent of any particle size may be used although matte agents having a particle size of about 0.1 μm to 30 μm are preferably used in the practice of the invention. The particle size distribution of the matte agent may be either narrow or wide. Nevertheless, since the haze and surface luster of photosensitive material are largely affected by the matte agent, it is preferred to adjust the particle size, shape and particle size distribution of a matte agent as desired during preparation of the matte agent or by mixing plural matte agents.

The back layer should preferably have a degree of matte as expressed by a Bekk smoothness of 10 to 250 seconds, more preferably 50 to 180 seconds.

In the photothermographic material of the invention, the matte agent is preferably added to an outermost surface layer, a layer functioning as an outermost surface layer or a layer close to the outer surface, and especially a layer functioning as a so-called protective layer.

In the practice of the invention, the binder used in the backing layer is preferably transparent or semi-transparent and generally colorless. Exemplary binders are naturally occurring polymers, synthetic resins, polymers and copolymers, and other film-forming media, for example, gelatin, gum arabic, poly(vinyl alcohol), hydroxyethyl cellulose, cellulose acetate, cellulose acetate butyrate, poly(vinyl pyrrolidone), casein, starch, poly(acrylic acid), poly(methyl methacrylate), polyvinyl chloride, poly(methacrylic acid), copoly(styrene-maleic anhydride), copoly(styrene-acrylonitrile), copoly(styrene-butadiene), polyvinyl acetals (e.g., polyvinyl formal and polyvinyl butyral), polyesters, polyurethanes, phenoxy resins, poly(vinylidene chloride), polyepoxides, polycarbonates, poly(vinyl acetate), cellulose esters, and polyamides. The binder may be dispersed in water, organic solvent or emulsion to form a dispersion which is coated to form a layer.

In the photosensitive material of the invention, the back layer may be an antihalation layer at the same time. The back layer preferably has a maximum absorbance of 0.3 to 2, more preferably 0.5 to 2 in the desired wavelength range and after processing, an absorbance or optical density of 0.001 to less than 0.5, more preferably 0.001 to less than 0.3 in the visible range. Examples of the antihalation dye used in the back layer are as previously described for the antihalation layer.

A backside resistive heating layer as described in U.S. Pat. Nos. 4,460,681 and 4,374,921 may be used in a thermographic imaging system according to the present invention.

As the outermost layer on the photosensitive layer-bearing side of the photothermographic material of the invention, a layer containing hydrophilic colloid as a binder is preferably provided. The outermost layer is referred to as a "surface protective layer," hereinafter. The hydrophilic colloid includes gelatin, casein, agar, etc., with the gelatin being most preferred. The gelatin may be lime-treated gelatin, acid-treated gelatin or the like while gelatin derivatives are also useful. The binder of the surface protective layer may contain a polymer latex such as polyethyl acrylate latex in addition to the hydrophilic colloid.

If desired, the surface protective layer is crosslinked with a crosslinking agent. The crosslinking agent is selected from those compounds well known as the crosslinking agent for hydrophilic colloid such as active halogen, vinyl sulfone, and epoxy compounds.

Also contained in the surface protective layer is a matte agent which is preferably fine particles of polystyrene, polymethyl methacrylate, and silica. The matte agent preferably has a particle size of 0.2 to 20 $\mu$m, more preferably 0.5 to 10 $\mu$m. The amount of the matte agent added is preferably 10 to 200 mg/m$^2$, more preferably 20 to 100 mg/m$^2$ although it varies with a particular layer construction, layer thickness, and intended application of the photothermographic material.

A lubricant is also contained in the surface protective layer. Well-known lubricants such as silicon compounds and paraffin are useful.

The photosensitive material of the invention may have an antistatic or electroconductive layer, for example, a layer containing soluble salts (e.g., chlorides and nitrates), an evaporated metal layer, or a layer containing ionic polymers as described in U.S. Pat. Nos. 2,861,056 and 3,206,312 or insoluble inorganic salts as described in U.S. Pat. No. 3,428,451.

A method for producing color images using the photothermographic material of the invention is as described in JP-A 13295/1995, page 10, left column, line 43 to page 11, left column, line 40. Stabilizers for color dye images are exemplified in UKP 1,326,889, U.S. Pat. Nos. 3,432,300, 3,698,909, 3,574,627, 3,573,050, 3,764,337, and 4,042,394.

In the practice of the invention, the photothermographic emulsion can be coated by various coating procedures including dip coating, air knife coating, flow coating, and extrusion coating using a hopper of the type described in U.S. Pat. No. 2,681,294. If desired, two or more layers may be concurrently coated by the methods described in U.S. Pat. No. 2,761,791 and UKP 837,095.

In the photothermographic material of the invention, there may be contained additional layers, for example, a dye accepting layer for accepting a mobile dye image, an opacifying layer when reflection printing is desired, a protective topcoat layer, and a primer layer well known in the photothermographic art. The photosensitive material of the invention is preferably such that only a single sheet of the photosensitive material can form an image. That is, it is preferred that a functional layer necessary to form an image such as an image receiving layer does not constitute a separate member.

The photosensitive material of the invention may be developed by any desired method although it is generally developed by heating after imagewise exposure. The preferred developing temperature is about 80 to 250° C., more preferably 100 to 140° C. and the preferred developing time is about 1 to 180 seconds, more preferably about 10 to 90 seconds.

Any desired technique may be used for the exposure of the photothermographic material of the invention. The preferred light source for exposure is a laser, for example, a gas laser, YAG laser, dye laser, and semiconductor laser. A semiconductor laser combined with a second harmonic generating device is also useful.

Upon exposure, the photosensitive material of the invention tends to generate interference fringes due to low haze. Known techniques for preventing generation of interference fringes are a technique of obliquely directing laser light to a photosensitive material as disclosed in JP-A 113548/1993 and the utilization of a multi-mode laser as disclosed in WO 95/31754. These techniques are preferably used herein.

Upon exposure of the photosensitive material of the invention, exposure is preferably made by overlapping laser light so that no scanning lines are visible, as disclosed in SPIE, Vol. 169, Laser Printing 116-128 (1979), JP-A 51043/1992, and WO 95/31754.

EXAMPLE

Examples of the present invention are given below by way of illustration and not by way of limitation.

Example 1

Measurement of moisture content of binder

A solution or dispersion of the polymer used in the undercoat layer or photosensitive layer, non-photosensitive layer or surface protective layer to be described below was coated on a glass plate and dried at 50° C. for one hour to form a model polymer film of 100 $\mu$m thick. When two or more polymers were used as a binder in the layer, a sample was prepared by mixing these polymers in the same ratio as in that layer. The model polymer film was stripped from the glass plate and allowed to stand at 25° C. and RH 60% for 3 days before its weight (W1) was measured. The model polymer film was then allowed to stand at 25° C. in vacuum for 3 days. Immediately thereafter, the film was placed in a weighing bottle having a known weight (W2). From the weight (W3) of the bottle, the weight of the dry polymer film was calculated (W0=W3−W2). The equilibrium moisture content (Weq) of the polymer was calculated according to the equation: Weq=(W1−W0)/W0×100% by weight.

Undercoating solution

An undercoating solution was prepared by adding 300 ml of a styrene-butadiene copolymer latex (concentration 30 wt %) shown in Table 1, 0.1 g of microparticulate polymethyl methacrylate (mean particle size 2.5 $\mu$m), and 20 ml of Surfactant B (concentration 1 wt %) shown below to 680 ml of water. The styrene-butadiene copolymer latex shown in Table 1 was found to be a latex of a copolymer having an equilibrium moisture content of less than 2 wt % at 25° C. and RH 60% as measured by the above-described procedure.

Surfactant B

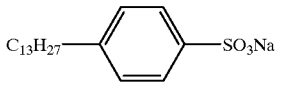

Undercoated support

On one surface of a biaxially oriented PET support of 180 μm thick tinted with a blue dye, the undercoating solution was applied by means of a bar coater and dried at 5 180° C. for 5 minutes to form an undercoat layer having a dry thickness of 0.2 μm, obtaining an undercoated support.

Silver halide grains A

In 700 ml of water were dissolved 22 grams of phthalated gelatin and 30 g of potassium bromide. The solution was adjusted to pH 5.0 at a temperature of 40° C. To the solution, 159 ml of an aqueous solution containing 18.6 grams of silver nitrate and an aqueous solution containing potassium bromide and potassium iodide in a molar ratio of 92:8 were added over 10 minutes by the controlled double jet method while maintaining the solution at pAg 7.7. Then, 476 ml of an aqueous solution containing 55.4 grams of silver nitrate and an aqueous solution containing 8 μmol/liter of dipotassium hexachloroiridate and 1 mol/liter of potassium bromide were added over 30 minutes by the controlled double jet method while maintaining the solution at pAg 7.7. The pH of the solution was lowered to cause flocculation and sedimentation for desalting. The solution was adjusted to pH 5.9 and pAg 8.0 by adding 0.1 gram of phenoxyethanol. There were obtained cubic grains of silver iodobromide having a silver iodide content of 8 mol % in the core and 2 mol % on the average, a mean grain size of 0.07 μm, a coefficient of variation of the projected area diameter of 8%, and a (100) face proportion of 79%.

The thus obtained silver halide grains were heated at 60° C., to which 85 μmol of sodium thiosulfate, 11 μmol of 2,3,4,5,6-pentafluorophenyldiphenylphosphine selenide, 2 μmol of Tellurium compound 1, 3.3 μmol of chloroauric acid, and 230 μmol of thiocyanic acid were added per mol of silver. The solution was ripened for 120 minutes and the temperature was then lowered to 50° C. With stirring, $5\times10^{-4}$ mol of Sensitizing dye A and $2\times10^{-4}$ mol of Sensitizing dye B, both per mol of the silver halide, were added to the emulsion. Further, 3.5 mol % of potassium iodide based on the moles of silver was added to the emulsion, which was agitated for 30 minutes and quenched to 30° C., completing the preparation of silver halide grains A.

Note that Tellurium compound 1 and Sensitizing dyes A and B are shown below.

Tellurium compound 1

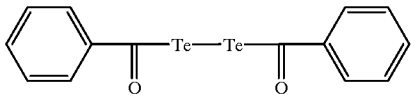

Sensitizing dye A

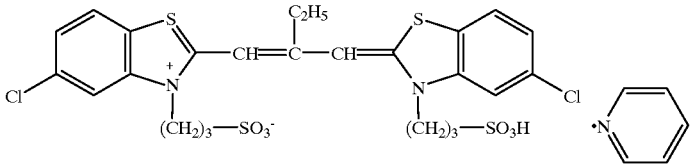

Sensitizing dye B

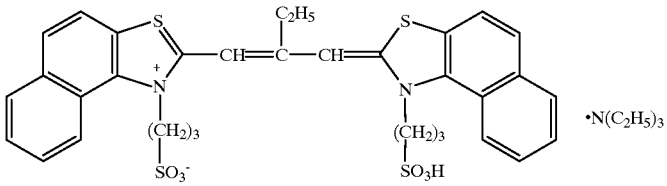

Microcrystalline dispersion of organic acid silver

A mixture of 40 grams of behenic acid, 7.3 grams of stearic acid, and 500 ml of water was stirred at a temperature of 90° C. for 15 minutes. Then, 187 ml of 1N NaOH aqueous solution was added over 15 minutes and 61 ml of 1N nitric acid aqueous solution added to the solution, which was cooled to 50° C. Next, 124 ml of 1N silver nitrate aqueous solution was added over 2 minutes to the solution, which was stirred for 30 minutes at the temperature. Thereafter, the solids were separated by suction filtration and washed with water until the water filtrate reached a conductivity of 30 μS/cm. The thus collected solids were handled as wet cake without drying. To 34.8 g calculated as dry solids of the wet cake were added 12 grams of polyvinyl alcohol and 150 ml of water. They were thoroughly mixed to form a slurry. A vessel was charged with the slurry together with 840 grams of zirconia beads having a mean diameter of 0.5 mm. A dispersing machine (¼G Sand Grinder Mill by Imex K.K.) was operated for 5 hours for dispersion, completing the preparation of a microcrystalline dispersion of organic acid silver needle grains having a mean minor diameter of 0.044 μm, a mean major diameter of 0.8 μm and a coefficient of variation of the projected area of 30% as measured by electron microscope observation.

Solid particle dispersions of chemical addenda

Solid particle dispersions of tetrachlorophthalic acid, 4-methylphthalic acid, 1,1-bis(2-hydroxy-3,5-dimethylphenyl)-3,5,5-trimethylhexane, phthalazine, and tribromomethylphenylsulfone were prepared.

To tetrachlorophthalic acid were added 0.81 grams of hydroxypropylmethyl cellulose and 94.2 ml of water. They were thoroughly agitated to form a slurry, which was allowed to stand for 10 hours. A vessel was charged with the slurry together with 100 grams of zirconia beads having a mean diameter of 0.5 mm. A dispersing machine as above was operated for 5 hours for dispersion, obtaining a solid particle dispersion of tetrachlorophthalic acid in which particles with a diameter of 1.0 μm or less accounted for 70% by weight. Solid particle dispersions of the remaining chemical addenda were similarly prepared by properly changing the amount of dispersant and the time of dispersion to achieve a desired mean particle size.

Photosensitive layer coating solution

A photosensitive layer coating solution was prepared by adding silver halide grains A in an amount of 10 mol % of silver halide based on the moles of organic acid silver, the polymer latex and the chemical addenda to the above-prepared microcrystalline dispersion of organic acid silver (equivalent to 1 mol of silver). The chemical addenda were added in the form of solid particle dispersions as mentioned above.

| | |
|---|---|
| Binder (Table 1) | 430 g |
| Tetrachlorophthalic acid | 5 g |
| 1,1-bis(2-hydroxy-3,5-dimethyl-phenyl)-3,5,5-trimethylhexane | 98 g |
| Phthalazine | 9.2 g |
| Tribromomethylphenylsulfone | 12 g |
| 4-methylphthalic acid | 7 g |

Non-photosensitive layer coating solution

A non-photosensitive layer coating solution was prepared by adding 0.13 g of Surfactant B and 40 g of water to 10 g of the binder shown in Table 1.

Surfactant B

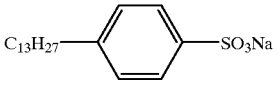

Protective layer coating solution

A surface protective layer coating solution was prepared by adding 0.26 gram of Surfactant A, 0.09 gram of Surfactant B, 0.9 gram of silica fine particles having a mean particle size of 2.5 μm, and 64 grams of water to 10 grams of the binder shown in Table 1.

Surfactant A

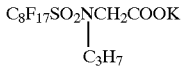

Surfactant B

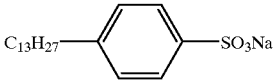

Color developing dispersion

To 35 g of ethyl acetate were added 2.5 g of Compound 1 and 7.5 g of Compound 2. The mixture was agitated for dissolution. The solution was combined with 50 g of a 10 wt % polyvinyl alcohol solution and agitated for 5 minutes by means of a homegenizer. Thereafter, the ethyl acetate was volatilized off for solvent removal purpose. Dilution with water yielded a color developing dispersion.

Compound 1

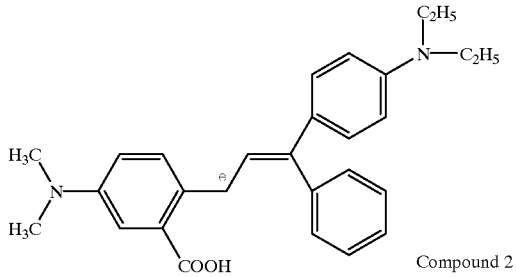

Compound 2

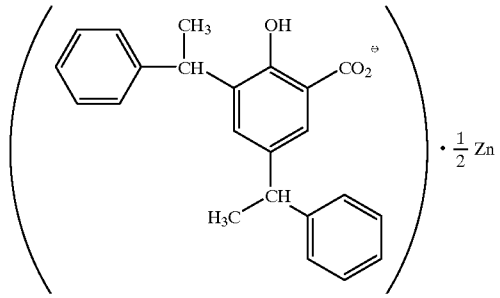

Back surface coating solution

A back surface coating solution was prepared by adding 50 g of the color developing dispersion, 20 g of Compound 3, 250 g of water to 30 g of polyvinyl alcohol.

Compound 3

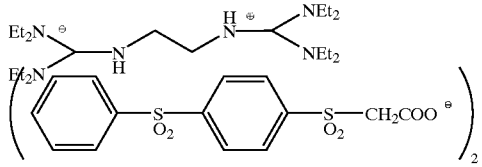

Coated sample

On the surface of the undercoated support opposite to the undercoat layer, the back surface coating solution was applied by means of a slide hopper and dried at 40° C. for 20 minutes so as to provide an optical density of 0.7 at 660 nm. Then, on the undercoat layer of the support, the photosensitive layer coating solution, non-photosensitive layer coating solution, and surface protective layer coating solution were concurrently applied by means of a slide hopper so that the photosensitive layer might have a silver coverage of 1.9 g/m$^2$ and the non-photosensitive layer and surface protective layer might have a binder coverage of 0.5 g/m$^2$ and 1.8 g/m$^2$, respectively. After the application, the film was maintained at 10° C. and RH 60% for one minute and dried at 40° C. for 20 minutes. The thus obtained sample was maintained at 25° C. and RH 60% for 14 days and examined by the following test.

Adhesion test

Using a razor, the surface of the sample on the same side as the photosensitive layer was scribed with six cut lines at a spacing of 4 mm in each of orthogonal directions, defining 25 square sections. The cut depth reached the support surface. A Mylar tape of 25 mm wide was attached to the scribed surface and fully pressed thereto. After 5 minutes from the pressure bonding, the tape was quickly pulled and peeled at a peeling angle of 180°. The number of peeled sections of the photosensitive layer was counted. The sample was rated by the following criterion.

| Rating | Number of peeled sections |
|---|---|
| A | 0 |
| B | 1 or less |
| C | less than 5 |
| D | 5 or more |

Samples rated A or B are practically acceptable.

Separately, the coated sample was pressed onto a heating drum at 120° C. for 25 seconds for heat development. The thus processed sample was subject to the same adhesion test. The results are shown in Table 1.

TABLE 1

| Sample No. | Undercoat layer binder | Initial adhesion | Adhesion after processing |
|---|---|---|---|
| 101* | none | D | C |
| 102 | P-101 | B | A |
| 103 | P-103 | B | A |
| 104 | P-105 | B | A |
| 105 | LACSTAR 5215A | B | A |
| 106 | Nipol Lx426 | B | A |
| 107 | L1151 | B | A |

*outside the scope of the invention

As is evident from Table 1, the samples within the scope of the invention show improved adhesion between the support and the photosensitive layer. Separately, the samples were examined for photographic properties, finding no substantial difference in maximum density, fog, sensitivity and image color.

Example 2

Samples were prepared as in Example 1 except that 2.5 g of a sodium salt of 2,4-dichloro-6-hydroxy-1,3,5-triazine was added to the undercoating solution. The samples were subject to the adhesion test, with the results shown in Table 2.

TABLE 2

| Sample No. | Undercoat layer binder | Initial adhesion | Adhesion after processing |
|---|---|---|---|
| 101* | none | D | C |
| 102 | P-101 | A | A |
| 103 | P-103 | A | A |
| 104 | P-105 | A | A |
| 105 | LACSTAR 5215A | A | A |
| 106 | Nipol Lx426 | A | A |
| 107 | L1151 | A | A |

*outside the scope of the invention

As is evident from Table 2, the samples within the scope of the invention show improved adhesion between the support and the photosensitive layer. Separately, the samples were examined for photographic properties, finding no substantial difference in maximum density, fog, sensitivity and image color.

Example 3

Samples were prepared as in Example 1 except that the support surface was subject to corona discharge treatment before the undercoating solution was applied thereto. The samples were subject to the adhesion test, obtaining results equivalent to Example 1.

Example 4

Samples were prepared as in Example 2 except that the support surface was subject to corona discharge treatment before the undercoating solution was applied thereto. The samples were subject to the adhesion test, obtaining results equivalent to Example 2.

Example 5

Samples were prepared as in Example 1 except that after the undercoating solution was applied to the support surface, the undercoat surface was subject to corona discharge treatment. The samples were subject to the adhesion test, obtaining results equivalent to Example 1.

Reasonable modifications and variations are possible from the foregoing disclosure without departing from either the spirit or scope of the present invention as defined by the claims.

I claim:

1. A process for preparing a photothermographic material comprising:

a support of polyester, at least one photosensitive layer on at least one surface of the support containing a photosensitive silver halide, a binder, an organic silver salt, an a reducing agent for the organic silver salt, and at least one undercoat layer between the support and the photosensitive layer containing a styrene-butadiene copolymer, said process comprising:

forming said photosensitive layer by applying a coating solution of the binder dispersed in a solvent containing at least 30% by weight of water and drying the coating, the binder being composed of at least 50% by weight of a polymer having an equilibrium moisture content of up to 2% by weight at 25° C. and RH 60%.

2. The process according to claim 1, further comprising the step of forming said undercoat layer by applying a coating solution comprising the styrene-butadiene copolymer in an aqueous solvent, followed by drying.

3. The process according to claim 1, further comprising the step of forming said undercoat layer by applying a coating solution comprising the styrene-butadiene copolymer and a crosslinking agent in an aqueous solvent, followed by drying, wherein said crosslinking agent is an epoxy, isocyanate, melamine or active halogen crosslinking agent.

4. The process according to claim 1, wherein in said undercoat layer, the styrene-butadiene copolymer is contained in an amount of at least 50% by weight of an entire binder.

5. The process according to claim 1, wherein in said undercoat layer, the styrene-butadiene copolymer is contained in an amount of at least 70% by weight of an entire binder.

6. The process according to claim 1, wherein said undercoat layer further contains a matte agent.

7. The process according to claim 6, wherein the matte agent is styrene, polymethyl methacrylate or silica in fine particle form having a mean particle size of about 0.2 to 5 $\mu$m.

8. The process according to claim 1, wherein said undercoat layer has a thickness of about 0.1 to 10 $\mu$m.

9. The process according to claim 1, wherein said undercoat layer has a thickness of about 0.2 to 2 $\mu$m.

10. The process according to claim 1, wherein in said photosensitive layer, the polymer having an equilibrium moisture content of up to 2% by weight at 25° C. and RH 60% is a styrene-butadiene copolymer.

* * * * *

UNITED STATES PATENT AND TRADEMARK OFFICE

CERTIFICATE OF CORRECTION

PATENT NO. : 6,132,948

DATED : October 17, 2000

INVENTOR(S) : Akira HATAKEYAMA

It is certified that error appears in the above-identified patent and that said Letters Patent is hereby corrected as shown below:

Title page, item

[73] change "Minami-ashigara, Japan" to --Kanagawa, Japan--;

Column 22, line 25, change "an" (second occurrence) to --and--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*